US009194324B2

(12) United States Patent
Momino

(10) Patent No.: US 9,194,324 B2
(45) Date of Patent: Nov. 24, 2015

(54) INTERNAL COMBUSTION ENGINE CONTROL METHODS

(71) Applicant: KABUSHIKI KAISHA TOYOTA JIDOSHOKKI, Kariya-shi, Aichi-ken (JP)

(72) Inventor: Hiroshi Momino, Kariya (JP)

(73) Assignee: KABUSHIKI KAISHA TOYOTA JIDOSHOKKI, Aichi-ken (JP)

( * ) Notice: Subject to any disclaimer, the term of this patent is extended or adjusted under 35 U.S.C. 154(b) by 281 days.

(21) Appl. No.: 14/049,656

(22) Filed: Oct. 9, 2013

(65) Prior Publication Data

US 2014/0096744 A1 Apr. 10, 2014

(30) Foreign Application Priority Data

Oct. 9, 2012 (JP) ..... 2012-223932

(51) Int. Cl.

| | |
|---|---|
| ***F02D 41/10*** | (2006.01) |
| ***F02D 41/30*** | (2006.01) |
| ***F02D 41/14*** | (2006.01) |
| ***F02D 41/06*** | (2006.01) |
| ***F02D 31/00*** | (2006.01) |

(52) U.S. Cl.

CPC ..... *F02D 41/30* (2013.01); *F02D 31/007* (2013.01); *F02D 41/064* (2013.01); *F02D 41/10* (2013.01); *F02D 41/1402* (2013.01)

(58) Field of Classification Search

CPC ..... F02D 41/30; F02D 41/10; F02D 41/045; F02D 31/007

USPC ..... 701/103–105, 110; 123/406.23–406.25, 123/406.5, 436, 492, 349–350

See application file for complete search history.

(56) References Cited

U.S. PATENT DOCUMENTS 6,347,680 B1 2/2002 Mianzo et al.

FOREIGN PATENT DOCUMENTS

| | | | |
|---|---|---|---|
| EP | 0980972 | A2 | 2/2000 |
| EP | 1057990 | A2 | 12/2000 |
| EP | 1985828 | A1 | 10/2008 |
| JP | 59-173534 | A | 10/1984 |
| JP | 06-43237 | U | 6/1994 |
| JP | 2008-82303 | A | 4/2008 |

OTHER PUBLICATIONS

Extended European Search Report, dated Jan. 28, 2014, issued by the European Patent Office, in counterpart Application No. 13187010.7.

*Primary Examiner* — Hai Huynh

(74) *Attorney, Agent, or Firm* — Sughrue Mion, PLLC

(57) ABSTRACT

A control apparatus controls an actual output engine RPM close to a target RPM that is based on an operational amount of an operating member independent of engine load fluctuations. The control apparatus temporarily increases the target RPM relative to a basic target RPM previously determined according to the operational amount. An acceleration control gradually increases the target RPM equal to or greater than a predetermined increase rate. When the temporary increase and acceleration controls are performed simultaneously, and the temporary increase control is later canceled, an increase rate of the target RPM is set equal to or greater than an increase rate of a basic target RPM corresponding to the operational amount so the target RPM does not become lower than a present RPM. The target RPM and the basic target RPM are thereby gradually matched with each other.

3 Claims, 4 Drawing Sheets

INTERNAL COMBUSTION ENGINE CONTROL METHODS

This application claims priority to Japanese patent application serial number 2012-223932, the contents of which are incorporated herein by reference.

BACKGROUND OF THE INVENTION

1. Field of the Invention

Embodiments of the present invention relate to an internal combustion engine control method. The control method helps to automatically control the fuel injection amount by setting the actual RPM of an internal combustion engine to a target RPM independent of fluctuations in the load of the internal combustion engine.

2. Description of the Related Art

There has been known a vehicle configured to utilize the power of an internal combustion engine for traveling and other operations. For example, a conventional forklift is equipped with an internal combustion engine such as a diesel engine, and utilizes the power of the internal combustion engine for both vehicle movement and the operation of a fork and a mast on which the fork is mounted. In order to facilitate the operation of the vehicle, the vehicle is supplied with an isochronous control function. The isochronous control helps to automatically control the fuel injection amount such that the RPM of the internal combustion engine is an RPM corresponding to the amount of operation by an operator even if the load of the internal combustion engine fluctuates.

In a forklift, for example, an internal combustion engine is operated, and a hydraulic pump is driven during the operation of the engine. The hydraulic pump supplies operating fluid to a hydraulic cylinder serving as an actuator to drive the fork and the mast. The load of the hydraulic pump fluctuates in loading/unloading cargo. In the situation where no isochronous control is employed, the engine load fluctuates due to the load fluctuation in the loading/unloading cargo. Thereby, the RPM of the engine and the RPM of the hydraulic pump are changed.

As a result, the amount of operating fluid is changed, and the speed at which the fork is raised or lowered, for example, is changed. Accordingly, when performing the operation of loading and unloading cargo, the operator must perform the operation while adjusting the amount by which the accelerator pedal is depressed according to the load fluctuation in the loading/unloading cargo.

In the case where isochronous control is adopted, the RPM of the internal combustion engine is automatically controlled so as to be constant (target RPM). Load fluctuation may be generated during loading/unloading of cargo. Isochronous control can be used during load fluctuation whether or not the operator moves the accelerator pedal. Also, when the accelerator pedal is depressed during traveling, the target RPM is determined according to the amount by which the accelerator pedal is depressed independent of whether there is any cargo or not.

In an internal combustion engine, there may be separately adopted special controls for cold starting. In such a control, in order to avoid the unintended stopping of the internal combustion engine (i.e., so-called engine stall) at the time of cold starting, the RPM of the engine is corrected such that the target RPM is higher than the RPM after the warming-up of the internal combustion engine.

Japanese Laid-Open Utility Model Publication No. 6-43237 discloses an idling rotational speed control apparatus for diesel engines. In the control apparatus, the target rotational speed (target RPM) is reduced stepwise with an increase in the temperature of cooling water. This helps to control the idling rotational speed through PID control without involving the generation of unnecessary engine revving.

Japanese Laid-Open Patent Publication No. 2008-82303 discloses a construction-equipment engine control apparatus. In the control apparatus, when an oil temperature detected based on a detection signal from an oil temperature sensor is lower than a predetermined temperature, the engine idling RPM is increased to a predetermined value.

If the related-art technique disclosed in Japanese Laid-Open Utility Model Publication No. 6-43237 or Japanese Laid-Open Patent Publication No. 2008-82303 would be applied to an internal combustion engine adopting isochronous control, the operator might feel discomfort. In this case, there is set a basic target RPM predetermined in correspondence with the depression angle of the accelerator pedal. A correction RPM at the time of warming-up is added to the basic target RPM. When, after warming-up, the engine is restored to the control where no correction RPM is added to the basic target RPM, the operator is caused to feel discomfort.

The related-art technique disclosed in Japanese Laid-Open Utility Model Publication No. 6-43237 or Japanese Laid-Open Patent Publication No. 2008-82303 is indicated by the dotted-line graph Z1 of FIG. 3. As shown in graph Z1, when the accelerator pedal is depressed while adding the correction RPM to the basic target RPM, the RPM of the internal combustion engine gradually increases. At point in time T1, the cooling water temperature or the oil temperature reaches the predetermined temperature and the addition of the correction RPM for setting the target RPM high is canceled. Thus, transition is effected to a control where no correction RPM is added. As a result, at point in time T1, the target RPM corresponding to the depression angle of the accelerator pedal is greatly lowered. Graph K1 of FIG. 3 indicates the locus of the value of the basic target RPM, which increases in correspondence with the depression of the accelerator pedal. Graph K2 indicates the locus of a value obtained by adding the correction RPM (which corresponds to the increase in the target RPM when the cooling water temperature or the oil temperature is lower than the predetermined temperature) to graph K1.

In the related-art control method indicated by graph Z1 of FIG. 3, the RPM of the internal combustion engine gradually increases during the period prior to point in time T1. At point in time T1, the target RPM is greatly lowered despite the depression of the accelerator pedal; after this, the target RPM increases. The actual RPM of the internal combustion engine is controlled so as to be in conformity with the target RPM. Thus, during the depression of the accelerator pedal (i.e., while acceleration is being required by the operator) when an increase in RPM is produced, an unintended abrupt reduction in RPM may occur. Thus, the operator feels discomfort, and may erroneously suppose that some malfunction has been caused in the internal combustion engine. In this case, the operator unnecessarily performs inspection or the like, which may result in in operational inefficiency.

Therefore, there is need in the art for an internal combustion engine control method which allows a change in the target RPM without causing the operator to feel discomfort.

SUMMARY OF THE INVENTION

According to an aspect of the invention, certain embodiments of the present invention include an internal combustion engine control method. In the method, a control apparatus determines a target RPM of the internal combustion engine based on an operational amount of an operating member independent of fluctuations in a load of the internal combustion engine. The control apparatus attempts to ensure that actual output RPM is close to the target RPM. The control apparatus performs a temporary increase control in which the target RPM is temporarily increased. A basic target RPM is previously determined based on the operational amount. An acceleration control acts to gradually increase the target RPM at an increase rate equal to or greater than a predetermined increase rate. When the temporary increase control and the acceleration control are performed simultaneously, and the temporary increase control is canceled, the control apparatus sets an increase rate of the target RPM at a level less than an increase rate of the basic target RPM. As mentioned earlier, this basic target RPM corresponds to the operational amount. In this way, target RPM does not become lower than the present RPM. In this way, the target RPM and the basic target RPM can be gradually matched.

Thus, in the case where the target RPM increases at a rate equal to or greater than the predetermined increase rate (in the case of abrupt acceleration), if the increase control were temporarily canceled, the target RPM would decrease. In this case, the control apparatus may prevent the target RPM from suddenly being reduced to match the basic target RPM. Instead, the target RPM is matched with the basic target RPM while the target RPM gently increases. As a result, it is possible to change the target RPM without causing the operator to feel discomfort.

According to another aspect of the invention, in an internal combustion engine control method, the control apparatus may perform a gentle acceleration control in which the target RPM is gradually increased at a rate less than the predetermined increase rate. Alternatively, the control apparatus may use a steady control in which the target RPM is kept constant. The temporary increase control and one of the gentle accelerator control or the steady control may be performed simultaneously. When the temporary increase control is canceled during simultaneous operation of the gentle acceleration control or the steady control, the control apparatus may gradually match the target RPM with the basic target RPM.

Thus, if the temporary increase control would be canceled during simultaneous operation of the gentle acceleration control or the steady control, the target RPM would become lower. In this case, the control apparatus may prevent the target RPM from suddenly being reduced to match the basic target RPM. Instead, the target RPM is matched with the basic target RPM while the target RPM gently changes (increases or decreases). As a result, it is possible to change the target RPM without causing the operator to feel discomfort.

According to another aspect of the invention, in an internal combustion engine control method, the temporary increase control may be executed in at least one of the following cases: when the temperature of the cooling water in the internal combustion engine is equal to or lower than a first predetermined temperature; when the temperature of the lubricant is equal to or lower than a second predetermined temperature; and when a time elapsed after a starting of the internal combustion engine is within a predetermined period. This makes it possible to appropriately set the temporary increase control.

DETAILED DESCRIPTION OF THE INVENTION

Figure 1:
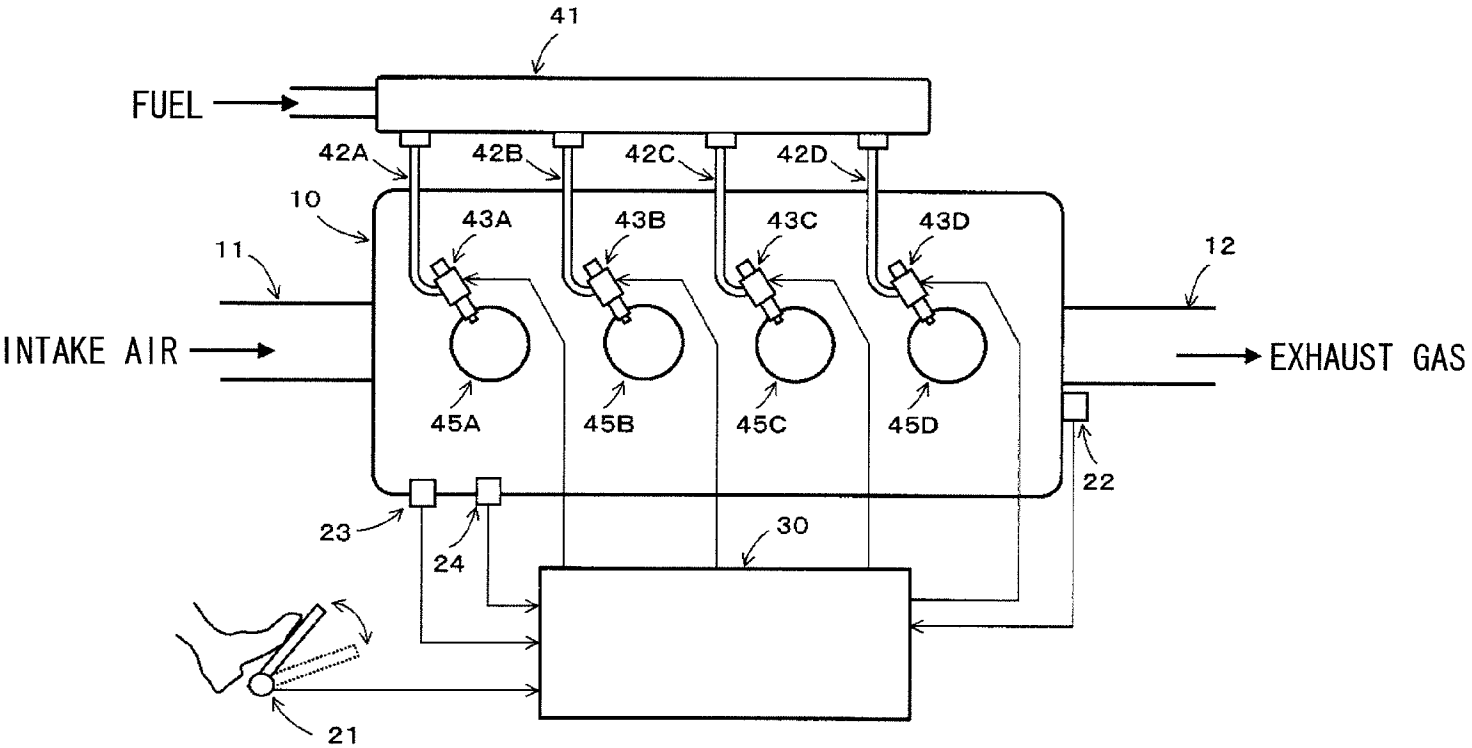
FIG. 1 is a schematic view of an internal combustion engine applied a control method according to an embodiment of a present invention.

Each of the additional features and teachings disclosed above and below may be utilized separately or in conjunction with other features and teachings to provide improved internal combustion engine control methods. Representative examples of the present invention, which utilize many of these additional features and teachings both separately and in conjunction with one another, will now be described in detail with reference to the attached drawings. This detailed description is merely intended to teach a person of ordinary skill in the art further details for practicing preferred aspects of the present teachings and is not intended to limit the scope of the invention. Only the claims define the scope of the claimed invention. Therefore, combinations of features and steps disclosed in the following detailed description may not be necessary to practice the invention in the broadest sense, and are instead taught merely to particularly describe representative examples of the invention. Moreover, various features of the representative examples and the dependent claims may be combined in ways that are not specifically enumerated in order to provide additional useful configurations of the present teachings.

An embodiment of an internal combustion engine will be described with reference to FIG. 1. The internal combustion engine is an engine 10 consisting, for example, of a diesel engine. Connected to the engine 10 is an intake pipe for introducing intake air to cylinders 45A to 45D of the engine 10. Also connected to the engine 10 is an exhaust pipe through which exhaust gas from the cylinders 45A to 45D is discharged. The engine 10 is provided with a rotation detecting means (sensor) 22 capable of detecting the RPM of the internal combustion engine (e.g., the RPM of the crankshaft), the rotation angle (e.g., the compression top dead center timing of each cylinder), etc. A control means (control apparatus) 30 can detect the output RPM, the rotation angle, etc. of the engine 10 based on a detection signal from the rotation detecting means 22.

The engine 10 is provided with a cooling water temperature detecting means (sensor) 23. The control means 30 can detect the temperature of the cooling water of the engine 10 based on a detection signal from the cooling water temperature detecting means 23. The engine 10 is provided with an oil temperature detecting means (sensor) 24. The control means 30 can detect the temperature of the lubricant of the engine 10 based on a detection signal from the oil temperature detecting means 24. The control means 30 can detect the amount by which an accelerator pedal is depressed by the operator (the depression angle) based on a detection signal from an accelerator opening-degree detecting means (sensor) 21. The accelerator pedal corresponds to the operating member, and the depression angle corresponds to the operational amount.

Fuel is supplied to a common rail 41 from a fuel tank (not shown). The fuel in the common rail 41 is maintained at a high pressure, and is supplied to injectors 43A to 43D via fuel piping 42A to 42D The injectors 43A to 43D are respectively provided in correspondence with the cylinders 45A to 45D. In response to a control signal from the control means 30, the injectors 43A to 43D respectively inject a predetermined amount of fuel into the cylinders with predetermined timing. The control means 30 takes in detection signals from various detecting means, etc. The control means 30 detects the operational condition of the engine 10, and outputs a control signal for driving the injectors 43A to 43D.

A forklift utilizes the power of the engine 10 for vehicle movement and for operating a fork and/or a mast. To relieve the operational burden on the operator, the control means 30 executes isochronous control. In the isochronous control, a target RPM is automatically set according, for example, to the depression angle by which the accelerator pedal is depressed by the operator. The fuel injection amount is automatically controlled such that the actual RPM of the engine 10 attains the target RPM.

To avoid unintended stopping of the engine 10 (so-called engine stall), the control means 30 adopts a temporary increase control in which the target RPM is temporarily increased. The above-mentioned control is executed at the time, for example, of cold starting. The target RPM is temporarily increased during either (1) a predetermined period of time since the starting of the engine, (2) when the temperature of the cooling water of the engine 10, or (3) when the temperature of the lubricant is low. In the example described below, the control occurs at the time of cold starting. However, the time when the temporary increase control is to be performed in order to avoid engine stall is not restricted to the time when cold starting is effected.

When the condition for canceling the temporary increase control is satisfied, the control means 30 reduces the target RPM by canceling the temporary increase in target RPM through the temporary increase control. However, when the target RPM is accidentally reduced during acceleration upon an acceleration request by the operator, the RPM of the engine 10 is abruptly reduced during the acceleration. This phenomenon involves an abrupt deceleration not intended by the operator, so that the operator feels discomfort, and may erroneously suppose that some malfunction has been generated in the engine 10. To prevent the operator from feeling this discomfort and from erroneously believing that a malfunction occurred, an internal combustion engine control method described below (a target RPM setting method) is performed.

Figure 2:
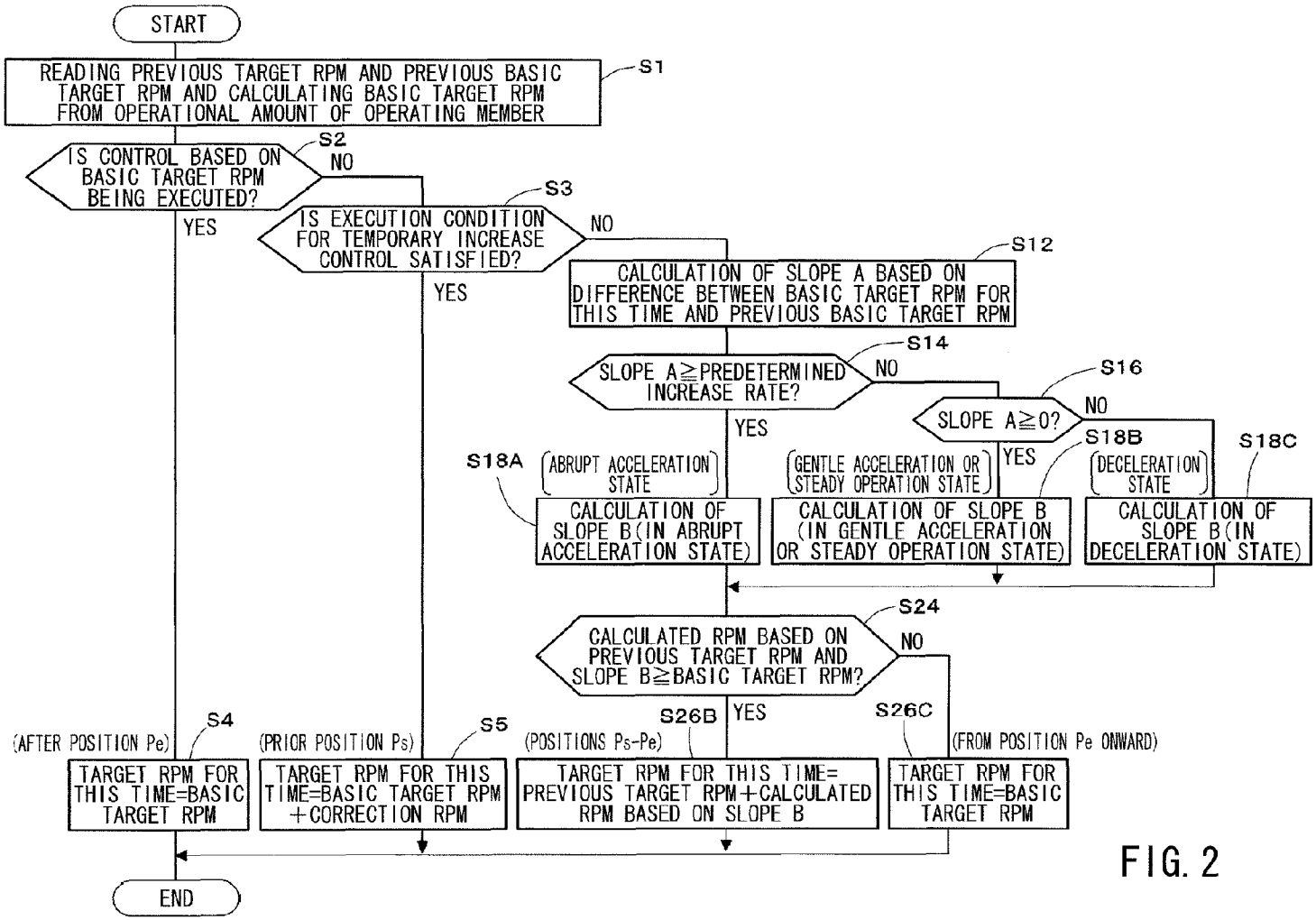
FIG. 2 is a flowchart of procedures of an embodiment of a control method.

The procedures for setting a target RPM will be described with reference to the flowchart of FIG. 2. The processing shown in the flowchart of FIG. 2 is executed by the control means 30 for each predetermined timing (e.g., at predetermined time intervals of 10 to 40 milliseconds).

A basic target RPM is obtained from a map or the like according to the operational amount of the operating member (e.g., the depression angle of the accelerator pedal). Conventionally, when the execution condition for the temporary increase control is satisfied, a correction RPM due to the temporary increase control and the basic target RPM are added together to set the target RPM. When the execution condition for the temporary increase control is not satisfied, the basic target RPM is set as the target RPM. In other words, during transition from the state in which the execution condition for the temporary increase control is satisfied to the state in which the execution condition is not satisfied, the correction RPM ceases to be added to the basic target RPM. As a result, the target RPM may be reduced instantaneously.

The present embodiment is characterized such that the setting of the target RPM occurs during the transition from the state in which the execution condition for the temporary increase control is satisfied to the state in which the execution condition is not satisfied. That is, in the present embodiment, the target RPM is not instantly reduced during the transition; instead, the target RPM is gradually changed.

In step S1, the control means 30 reads the previous target RPM and the previous basic target RPM. The basic target RPM for this time is calculated from the operational amount of the operating member (the depression angle of the accelerator pedal or the like), and the procedure advances to step S2.

In step S2, the control means 30 determines whether the control based on the basic target RPM is being executed or not. When the control based on the basic target RPM is being executed (YES), the procedure advances to step S4. When the control based on the basic target RPM is not being executed (NO), the procedure advances to step S3.

In step S2, it is determined whether or not warming-up has been completed. For example, when the previous target RPM is not more than the basic target RPM obtained from the previous operational amount, it is determined that the temporary increase control at the time of warming-up has been canceled and that the warming-up has been completed. It is also determined that the control based on the basic target RPM is being executed.

In step S4, the control means 30 sets the basic target RPM obtained in step S1 as the target RPM to be reached in this process. The target RPM in step S4 is set after warming-up and when the temporary increase control has been completed. The target RPM set in step S4 corresponds to the target RPM after position Pe as indicated in FIGS. 3 to 6.

In step S3, the control means 30 determines whether or not the execution condition for the temporary increase control in which the target RPM is temporarily increased is satisfied. For example, in the temporary increase control, it is determined whether or not the execution condition for the temporary increase control is satisfied in at least one of the following three (3) cases: (1) Whether the engine 10 is within a predetermined period of time (predetermined time, predetermine RPM, etc.) after the starting thereof, (2) Whether the temperature of the cooling water detected based on the detection signal from the cooling water temperature detecting means 23 is not higher than a first predetermined temperature, (3) Whether the temperature of the lubricant is not higher than a second predetermined temperature. This temperature is detected based on the detection signal from the oil temperature detecting means 24. When none of the execution conditions listed above are satisfied, it is determined that the canceling condition is satisfied. When the execution condition for the temporary increase control is satisfied (YES), the procedure advances to step S5. When the execution condition for the temporary increase control is not satisfied (NO), the procedure advances to step S12.

As shown in FIGS. 3 to 6, in step S5, the control means 30 sets an RPM obtained by adding together the correction RPM H and the basic target RPM (line K1) for this time. RPM H corresponds to an increase by the temporary increase control. This resulting RPM is the target RPM for this time. The processing in step 5 is for setting the target RPM prior to position Ps shown in FIGS. 3 to 6.

In step S12, the control means 30 calculates the Slope A of the basic target RPM based on the difference between the basic target RPM for this time and the previous basic target RPM. The procedure then advances to step S14.

In step S14, the control means 30 determines whether or not the Slope A is equal to or greater than a predetermined increase rate. When the Slope A is equal to or greater than the predetermined increase rate (YES), it is determined that abrupt acceleration is to be effected. Thereafter, the procedure advances to step S18A. When the Slope A is less than the predetermined increase rate (NO), it is determined that no abrupt acceleration is to be effected and the procedure advances to step S16.

In step S16, the control means determines whether or not the Slope A is equal to or greater than zero. When it is determined that the Slope A is equal to or greater than zero (YES), it is determined that gentle acceleration or steady operation is to be effected and the procedure advances to step S18B. When it is determined that the Slope A is less than zero (NO), it is determined that deceleration is to be effected and the procedure advances to step S18C. The term "steady operation" means an operation state of the internal combustion engine in which the RPM is constant with there being neither acceleration nor deceleration. The term "gentle acceleration" means gentle acceleration not corresponding to abrupt acceleration.

When it is determined that abrupt acceleration is to be effected, the procedure advances to step S18A. The control means 30 calculates an Slope B which leads to a relationship: 0<Slope B<Slope A (the increase rate of the basic target RPM) and the procedure advances to step S24. In step S18A, the Slope B in FIG. 3 (abrupt acceleration) is calculated. For example, the Slope B is calculated from Slope A/2 or the like. There are no particular limitations regarding the method of calculating Slope B.

Figure 3:
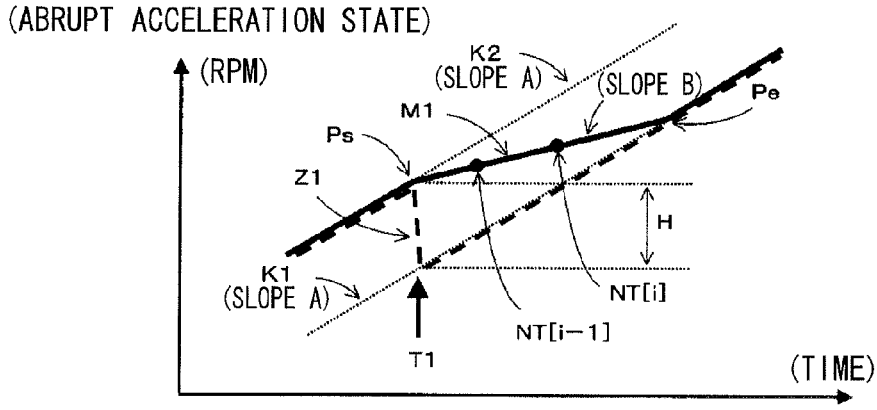
FIG. 3 is a time vs. RPM graph showing an abrupt acceleration in an embodiment of a control method.

Line M1 in FIG. 3 indicates the target RPM when the temporary increase control is canceled at point in time T1 in the abrupt acceleration state. In FIG. 3, Line K1 indicates the basic target RPM. Line K2 indicates the target RPM (=the basic target RPM+the correction RPM H due to the temporary increase control).

In FIGS. 3 to 6, the execution condition for the temporary increase control is satisfied prior to point in time T1. From point in time T1 onward, the canceling condition for the temporary increase control is satisfied. In FIG. 3, the abrupt acceleration state is indicated by the dotted-line line Z1. At this point, the conventional target RPM is immediately reduced from the target RPM (=the basic target RPM+the correction RPM H) (Line K2) to the basic target RPM (Line K1) at point in time T1. Thus, the operator senses an unintended abrupt deceleration and feels discomfort.

Solid-line Line M1 shows the target RPM in FIG. 3. Target RPM is shown between position Ps and Pe in FIG. 3 and at the Slope B (0<Slope B<Slope A (the increase rate of the basic target RPM)). Along this slope, the target RPM is gradually increased so that the target RPM may not be reduced. As a result, the operator does not sense discomfort resulting from an unintended abrupt deceleration during acceleration.

In the case where it is determined that gentle acceleration or steady operation is to be effected, the procedures advances to step S18B. The control means 30 appropriately calculates the Slope B, and the procedure advances to step S24. In step S18B, the Slope B in FIG. 4 (in the gentle acceleration state) or FIG. 5 (steady operation state) is calculated. For example, in the gentle acceleration state, the period of time elapsing from position Ps at point in time T1 to position Pe (position Pe is predicted), is set to a predetermined period of time. The Slope B is calculated using the set period of time, the RPM at position Ps, and the RPM at position Pe. Thus, in the gentle acceleration state (in the case of FIG. 4), the Slope B due to step S18B may be greater or less than zero. In the steady operation state (in the case of FIG. 5), the Slope B due to step S18B is less than zero. There are no particular limitations regarding the method of calculating the Slope B.

Figure 4:
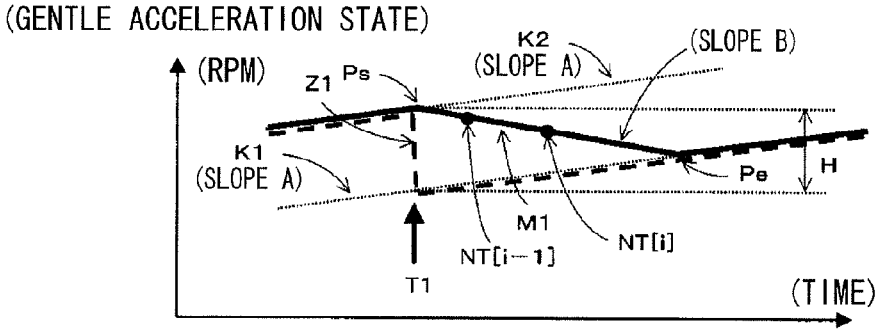
FIG. 4 is a time vs. RPM graph showing a gentle acceleration state in an embodiment of a control method.

Line M1 in FIG. 4 indicates the target RPM when the temporary increase control is canceled at point in time T1 in the gentle acceleration state. In FIG. 4, Line K1 indicates the basic target RPM. Line K2 indicates the target RPM (=the basic target RPM+the correction RPM H due to the temporary increase control). In FIG. 4, the gentle acceleration state is indicated by the dotted-line line Z1, The conventional target RPM is reduced immediately from the target RPM (=the basic target RPM+the correction RPM H) (Line K2) to the basic target RPM (Line K1) at a point in time T1. Thus, the operator senses discomfort during an unintended abrupt deceleration in the gentle acceleration state.

The target RPM in the present embodiment is indicated by the solid-line Line M1. At a Slope B between position Ps and Pe, the target RPM is gradually changed (e.g., reduced) so that the target RPM may not be abruptly reduced. As a result, the operator does not sense any discomfort caused by an unintended abrupt deceleration during the gentle acceleration state.

Figure 5:
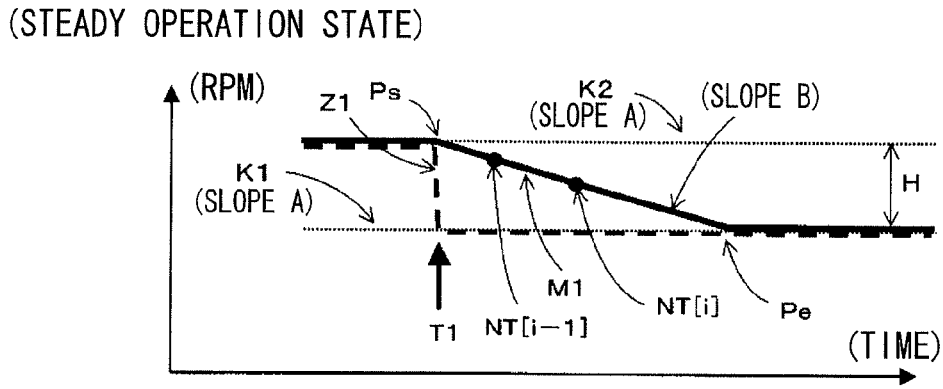
FIG. 5 is a time vs. RPM graph showing a steady operation state in an embodiment of a control method.

Line M1 in FIG. 5 indicates the target RPM when the temporary increase control is canceled at point in time T1 in the steady operation state. In the steady operation state, the speed is constant as there is neither acceleration nor deceleration. In FIG. 5, Line K1 indicates the basic target RPM. Line K2 indicates the target RPM (=the basic target RPM+the correction RPM H due to the temporary increase control).

In the steady operation state shown in FIG. 5, the conventional target RPM is, as indicated by the dotted-line line Z1. Here, the conventional target RPM is reduced immediately from the target RPM (=the basic target RPM+to the correction RPM H) (Line K2) to the basic target RPM (Line K1) at point in time T1. Thus, the operator senses an unintended abrupt deceleration during the steady operation state and feels discomfort.

In FIG. 5, the target RPM in the present embodiment is indicated by the solid-line Line M1. Along Slope B between position Ps and position Pe, the target RPM is gradually reduced so that the target RPM is not abruptly reduced. As a result, the operator does not sense any discomfort from an unintended abrupt deceleration during the steady operation state.

When it is determined that deceleration is to be effected, and the procedure advances to step S18C. Here the control means 30 roughly calculates the Slope B, and the procedure advances to step S24. In step S18C, the Slope B in FIG. 6 (deceleration state) is calculated. The Slope B in FIG. 6 (deceleration state) is set to infinity, and it is possible to reduce the target RPM instantly at point in time T1. Since the target RPM is not gradually reduced, it is possible to omit step S18C. In the case where the target RPM is to be gradually reduced from point in time T1 in the deceleration state, it is possible to set the Slope B to a desired limited value in step S18C.

Figure 6:
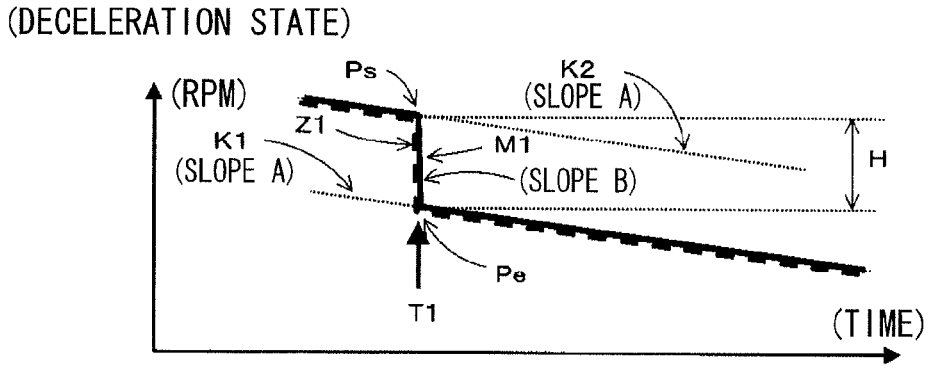
FIG. 6 is a time vs. RPM graph showing a deceleration state in an embodiment of a control method.

Line M1 in FIG. 6 indicates the target RPM in the case where the temporary increase control is canceled at point in time T1 in the deceleration state. In FIG. 6, Line K1 indicates the basic target RPM. Line K2 indicates the target RPM (=the basic target RPM+the correction RPM H due to the temporary increase control). In FIG. 6, the deceleration state is indicated by the dotted-line line Z1. The conventional target RPM is reduced immediately at point in time T1 from the target RPM (=the basic target RPM+the correction RPM H) (Line K2) to the basic target RPM (Line K1). However, since the engine is being decelerated, the operator experiences no particular sensation of discomfort. Thus, also the solid-line Line M1 indicating the target RPM in the present embodiment indicates the same operation as that of the dotted-line line Z1 indicating the conventional target RPM.

In step S24, the control means 30 determines whether or not the RPM, calculated based on the previous target RPM and the Slope B, is equal to or greater than the basic target RPM for this time. When it is determined that the RPM is equal to or greater than the basic target RPM for this time (YES), the existing state corresponds to the section between positions Ps and Pe in FIGS. 3 to 5, and the procedure advances to step S26B. When it is determined that the RPM is less than the basic target RPM for this time (NO), the existing state corresponds to the section from position Pe onward in FIGS. 3 to 5 and the procedure advances to step S26C.

In step S26B, the RPM is calculated based on the previous target RPM NT [i−1] and the Slope B. The control means 30 changes the RPM to the target RPM NT [i] to thereby complete the processing. In step S26B, the target RPM between positions Ps and Pe in FIGS. 3 to 5 is set.

In step S26C, the control means 30 sets the basic target RPM to the target RPM to thereby complete the processing. In step S26C of FIGS. 3 to 5, the target RPM for position Pe and onward is set.

As described above, in the case of abrupt acceleration, the basic target RPM increases at a rate not less than a predetermined increase rate. During abrupt acceleration, even if the temporary increase control is canceled at point in time T1, the target RPM gradually increases. This is indicated by Line M1 in FIG. 3. Thus, the target RPM (Line M1) is not abruptly reduced. Instead, the target RPM gradually increases and is matched with the basic target RPM (Line K1). Thus, the operator does not sense any discomfort from an unintended abrupt deceleration during abrupt acceleration.

In the gentle acceleration state, the basic target RPM increases at a rate less than the predetermined increase rate. In the gentle acceleration state, should the temporary increase control be canceled at point in time T1, the target RPM is thereby gradually changed. This is indicated by Line M1 in FIG. 4. Thus, the target RPM (Line M1) is not abruptly reduced. Instead, the target RPM is gradually changed and is matched with the basic target RPM (Line K1). Thus, the operator does not sense any discomfort from an unintended abrupt deceleration during the gentle acceleration state.

In steady operation state, the basic target RPM is constant. In the steady operation state, should the temporary increase control is canceled at point in time T1, the target RPM is gradually changed. This is indicated by Line M1 of FIG. 5. Thus, the target RPM (Line M1) is not abruptly reduced. Instead, while the target RPM is gradually reduced, then it is matched with the basic target RPM (Line K1). Thus, the operator does not sense any discomfort from an unintended abrupt deceleration during the steady operation state.

In the deceleration state, the basic target RPM decreases. During the deceleration state, should the temporary increase control be canceled at point in time T1, the target RPM is instantaneously reduced and matched with the basic target RPM. This is indicated by Line M1 of FIG. 6. However, since the engine is undergoing deceleration, the operator does not feel discomfort.

While the embodiments of invention have been described with reference to specific configurations, it will be apparent to those skilled in the art that many alternatives, modifications and variations may be made without departing from the scope of the present invention. Accordingly, embodiments of the present invention are intended to embrace all such alternatives, modifications and variations that may fall within the spirit and scope of the appended claims. For example, embodiments of the present invention should not be limited to the representative configurations, but may be modified, for example, as described below.

In the above embodiment, the target RPM is changed gradually so as to avoid an abrupt reduction in the target RPM during abrupt acceleration, gentle acceleration, and steady operation states. Instead, it is also possible for the control apparatus to monitor the injection amount of the injectors, with an abrupt reduction in the expected injection amount. When the abrupt reduction in the injection amount is to be expected, it is also possible for the control apparatus to perform control so as gradually change the injection amount. By suppressing the abrupt change in the injection amount, it is possible to appropriately prevent the operator from feeling discomfort as in the above-described embodiment.

The internal combustion engine control method is not restricted to the processing, operation, etc. described in the above embodiment.

The system to which the internal combustion engine control method according to the present invention is applicable is not restricted to the diesel engine of FIG. 1. The system is applicable to various internal combustion engines, gasoline engines, etc. in which fuel is injected from an injector. The system to which the control method is applicable is not restricted to a forklift. The system is applicable to various vehicles such as a power shovel in which the power of an internal combustion engine is utilized for both traveling and other vehicle operations.

As described above, the execution condition of the temporary increase control can be determined based on the temperature of cooling water, the temperature of lubricant, and a predetermined period of time after the starting of the engine. This, however, should not be construed restrictively.

In the above description, the expressions such as "greater than or equal to (≥)," "less than or equal to (≤)," "greater than (>)," and "less than (<)" may or may not be signs having an equal sign.

This invention claims:

1. An internal combustion engine control method comprising:

a control apparatus for determining a target RPM of the internal combustion engine based on an operational amount of an operating member independent of fluctuations in a load of the internal combustion engine;

the control apparatus performing control such that an actual output RPM is close to the target RPM;

the control apparatus performing a temporary increase control in which the target RPM is temporarily increased with respect to a basic target RPM previously determined in correspondence with the operational amount;

the control apparatus performing an acceleration control in which the target RPM is gradually increased at an increase rate equal to or greater than a predetermined increase rate; and in a state in which the temporary increase control and the acceleration control are performed simultaneously, when the temporary increase control is canceled, the control apparatus setting an increase rate of the target RPM at a level less than an increase rate of the basic target RPM corresponding to the operational amount so that the target RPM does not become lower than a present RPM, and the control apparatus gradually matching the target RPM with the basic target RPM.

2. The internal combustion engine control method of claim 1, further comprising:

the control apparatus performing a gentle acceleration control in which the target RPM is gradually increased at a rate less than the predetermined increase rate or a steady control in which the target RPM is kept constant; and in a state in which the temporary increase control and either the gentle acceleration control or the steady control are performed simultaneously, when the temporary increase control is canceled, the control apparatus gradually matching the target RPM with the basic target RPM.

3. The internal combustion engine control method of claim 1, wherein the temporary increase control is executed in at least one of the following cases: a case where a temperature of a cooling water of the internal combustion engine is equal to or lower than a first predetermined temperature; a case where a temperature of a lubricant is equal to or lower than a second predetermined temperature; and a case where a time elapsed after a starting of the internal combustion engine is within a predetermined period.

* * * * *